United States Patent [19]

Nordstrom et al.

[11] 4,436,044

[45] Mar. 13, 1984

[54] THREAD WIPING DEVICE

[75] Inventors: Eric W. Nordstrom, Forest Park; Laurence A. Manoski, Mt. Prospect, both of Ill.

[73] Assignee: Union Special Corporation, Chicago, Ill.

[21] Appl. No.: 303,649

[22] Filed: Sep. 18, 1981

[51] Int. Cl.[3] ..... D05B 65/06

[52] U.S. Cl. ..... 112/286; 112/301

[58] Field of Search ..... 112/286, 293, 301

[56] References Cited

U.S. PATENT DOCUMENTS

| | | | |
|---|---|---|---|
| 1,406,180 | 2/1922 | Fossa | 112/293 X |
| 1,988,460 | 1/1935 | Pikul | 112/286 X |
| 1,999,145 | 4/1935 | Vollman | 112/286 X |
| 2,251,676 | 8/1941 | Gunther | 112/286 X |
| 3,448,708 | 6/1969 | Ross | 112/253 |
| 3,494,316 | 2/1970 | Ross | 112/253 |
| 3,601,074 | 8/1971 | Von Hagen | 112/286 |
| 3,901,171 | 8/1975 | Rosa | 112/286 |

FOREIGN PATENT DOCUMENTS

| | | | |
|---|---|---|---|
| 52-21930 | 6/1977 | Japan | 112/286 |
| 1194967 | 6/1970 | United Kingdom | 112/301 |

*Primary Examiner*—Wm. Carter Reynolds

*Attorney, Agent, or Firm*—John W. Harbst; John A. Schaerli

[57] ABSTRACT

Mechanism on a sewing machine for engaging and withdrawing a severed sewing machine needle thread end from a workpiece at the completion of a sewing operation. The thread wiper mechanism includes a thread engaging element which is reciprocally movable along and about an axis extending generally parallel with the needle's path of travel with the element sweeping beneath the needle, across the needle's path and returning to its initial position at the completion of the sewing operation.

8 Claims, 3 Drawing Figures

THREAD WIPING DEVICE

FIELD OF THE INVENTION

The present invention relates to sewing machines, and more particularly, to needle thread wiping mechanisms for sewing machines.

BACKGROUND OF THE INVENTION

It is well known in the sewing machine art to provide a thread wiper for withdrawing the severed end of a needle thread from the workpiece at the completion of the sewing operation. If the severed end of the needle thread is not removed from the sewing area, it is apt to been drawn out along with the workpiece thereby causing a distended thread tail to be created on successive workpieces that are sewn.

The majority of thread wipers include a Bowden wire arranged for sliding movement within a guide tube. Some thread wiping devices employ a four bar linkage system for moving the thread engaging element across the needle's path. The drawbacks associated with either of these devices limit their feasability. Thread wipers which use Bowden wires are susceptible to kinks because of their thinness and are, therefore, delicate. In an industrial sewing environment, such frail or delicate mechanisms are impractical. On the other hand, four bar linkages are noisy and hinder the operator's access to the sewing area.

SUMMARY OF THE INVENTION

In view of the above, and in accordance with the present invention, there is provided a thread wiper mechanism which is self contained in the sewing head of the machine. The thread wiper mechanism of the present invention includes a thread engaging element means which, during operation, has a combined reciprocatory and oscillatory movement along and about a linear path extending generally parallel to the needle's path. The combined movement of the engaging element being timed such that the element is first rectilinearly moved to allow subsequent oscillatory movement to capture the needle thread and then is retracted to carry the needle thread away from the sewing area. To accomplish this end, the thread engaging element is carried on a spindle which is arranged generally parallel to the path of the needle with a bearing projecting from one side thereof. The bearing rolls in a slot provided in a guide member. The slot in the guide member includes an upper portion which extends generally parallel to the path of the needle and a second anfractuous portion which serves to oscillate the thread engaging element across the needle's path of travel. The drive member or actuator for the thread engaging element is compliently secured within the support plate such that if the severence of the needle thread is not accomplished, no destructive damage will be done to the mechanism.

With the above in mind, it is a general object of this invention to provide a needle thread wiper and thread end holder which will reliably withdraw the severed thread end from a sewn workpiece in such a manner that is avoids excessive thread tails.

It is another object of this invention to provide a needle thread wiper and thread end holder which will not hinder the operator's view of the stitching area nor detract from the space available near the stitching point for operator manipulation of a workpiece, or thread during insertion through the needle eye.

It is further object of this invention to provide a needle thread wiper which is fully retracted after each thread wiping operation.

Another object of this invention is to provide a needle thread wiper and thread end holder which operates to engage and manipulate a thread end with that degree of certainity which will ensure consistent withdrawal of thread ends from the work and retention of the thread ends out of entanglement with the beginning of the succeeding line of stitches.

It is a further object of this invention to provide a needle thread wiper and thread end holder that is efficient, reliable, durable and relatively economical to produce.

With the above and additional objects and advantages in view as will here and after appear, this invention comprises the devices, combinations, and arrangements of parts hereinafter described and illustrated in the accompanying drawings of a preferred embodiment in which.

DETAILED DESCRIPTION OF THE INVENTION

Figure 1:
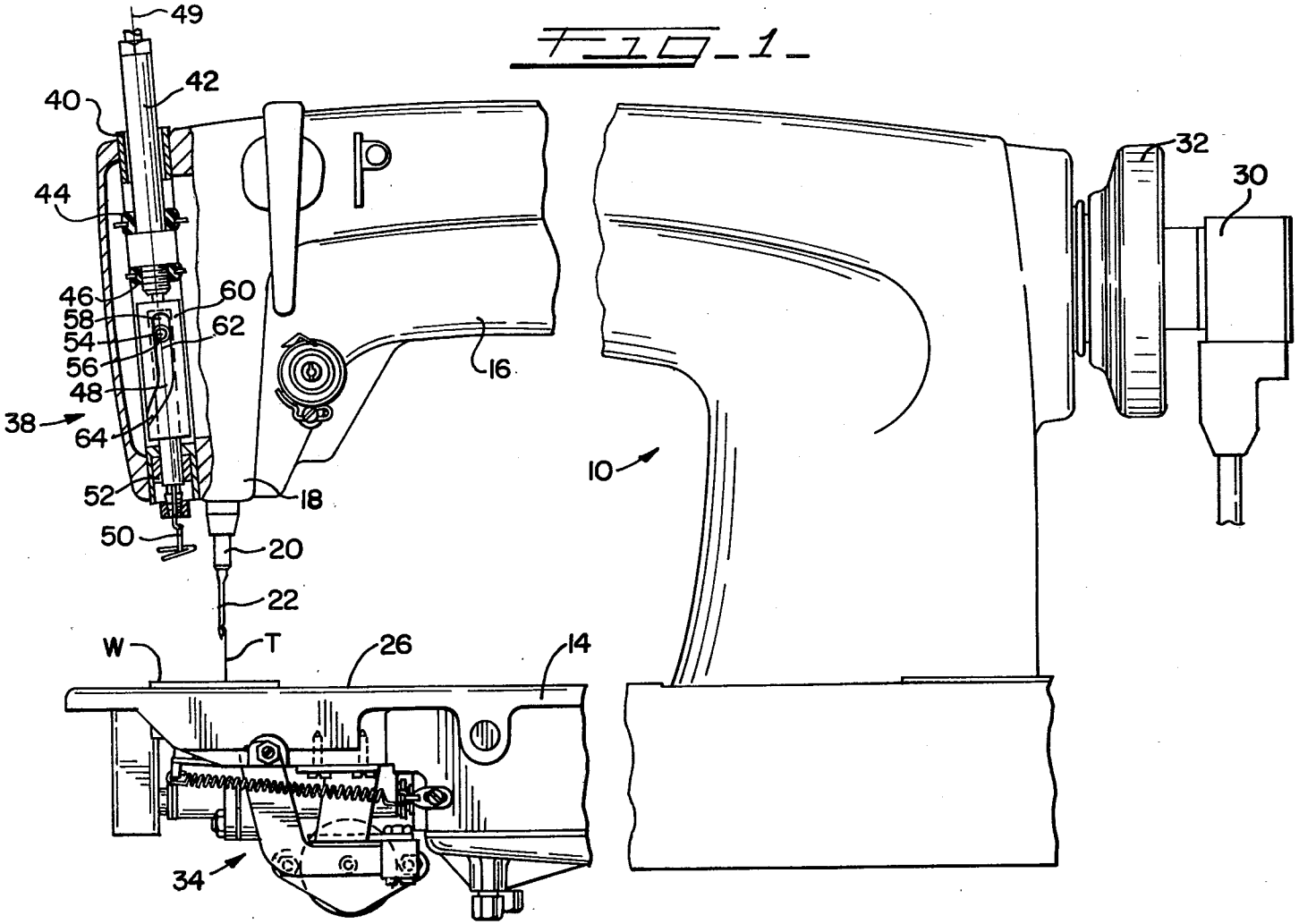
FIG. 1 represents a front elevational view, partly in section, of a sewing machine having the present invention applied thereto.

Referring now to the drawings, wherein like reference numerals indicate like parts throughout the several views, there is shown a sewing machine 10 having a frame including a work supporting bed 14 over which is supported a bracket arm 16 terminating in a sewing machine head 18. Supported in the sewing machine head for generally vertical endwise reciprocation is a needle bar 20 having detachably secured at its lower end one or more eye pointed, thread carrying needle means 22. Detachably secured upon the forward end of the bed 14 is an apertured throat plate 24 which allows passage of the needles through the work supporting surface 26 of the bed 14. The needle means are adapted to cooperate, in the usual manner, with complimentary stitch forming means 28 arranged beneath the work surface of the bed 14. An electromechanical synchronization device 30, connected to and driven by the sewing machine hand wheel 32 is operative, in a well known manner, to stop the needle in a predetermined position upon completion of the sewing operation. For purposes of this description, suffice it to say that a sewing operation is defined by that length of time the machine is sewing on any given operation.

The needle thread wiper of this invention is adapted for use with a machine wherein, at the completion of a sewn seam, the needle thread is severed beneath the work supporting bed. Many underbed thread trimmers are known for accomplishing such thread severing operation, any of which may be used in carrying out the present invention. In the illustrated embodiment, an undertrimmer 34 similar to that disclosed in U.S. Pat. No. 3,424,116 granted to W. R. Von Hagen on Jan. 28, 1969 and incorporated by reference herein is employed for severing the needle thread.

Figure 2:
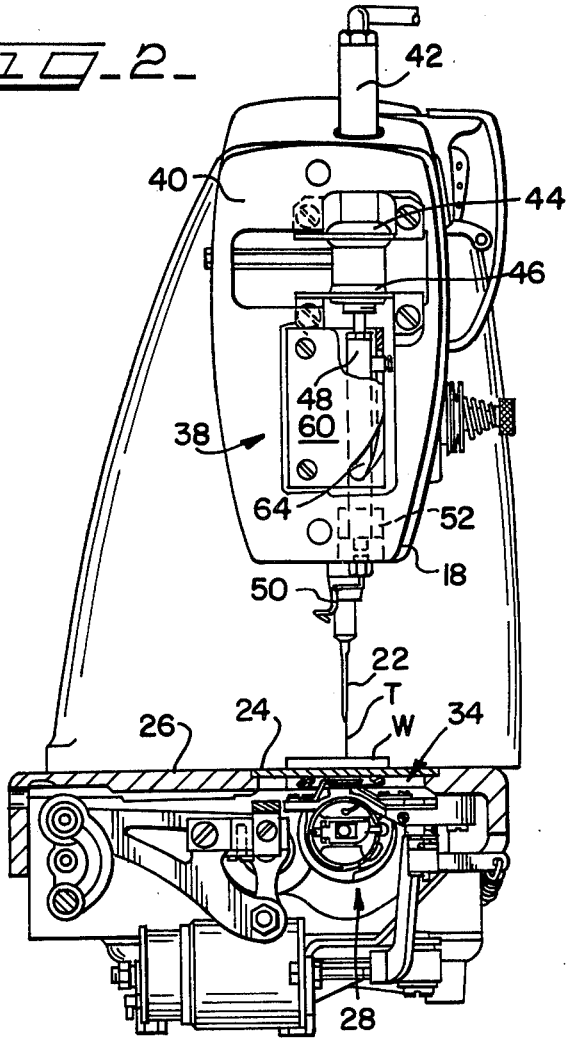
FIG. 2 represents an end view of the sewing machine shown in FIG. 1 with the end cover removed.

It will be noted, as shown in FIGS. 1 and 2, that when the needle thread is severed beneath the throat plate by the underbed thread trimmer, the thread end after severence may remain extending through the workpiece W. This depending thread is apt to become caught in the workpiece and distended if the workpiece is drawn away from the sewing area before the thread end is withdrawn therefrom.

Preferably, the needle thread wiper assembly 38 of this invention is carried by an end plate 40 detachably secured to the free end of the sewing machine head 18. To impart the desired movement to the thread wiper assembly, a drive member or actuator 42 which may be in the form of a fluidically operated cylinder, is provided. Mounting brackets 44 and 46 serve to compliantly secure the air cylinder to the support housing or plate 40. Adjustably secured to the operative end of the drive member is a spindle or rod 48. The free end of the rod 48 carries a thread engaging and gripping element 50. The lower end of the rod 48 passes through a fixedly secured self aligning bearing 52 carried by the housing 40. The rod 48 is arranged for both longitudinal reciprocatory movement and rocking or oscillatory movement about a fixed axis 49 (FIG. 1) extending generally parallel with the path of the needle. Intermediate its ends, the spindle 48 is provided with an outwardly extending pin 54 provided with a removable annular roller means or bearing 56. The roller 56 projects into and travels in a passage or slot 58 provided in a guide sleeve 60 which in turn is fixedly secured to the support plate 40. The side edges of the slot 58 tangentially engage the annular roller 56 whereby positively guiding same. The passage or slot 58 cut in the guide member 60, in which the roller 56, carried by the spindle 48, rolls and is positively guided, includes an upper generally straight section 62 extending generally parallel with the path of the needle and an anfractuous or helically shaped lower section 64. In that the movement of the thread engaging element is governed by the slot, it will be appreciated, that intermediate it's extreme positons, the thread engaging and gripping element will be moved along an axis extending generally parallel with the path of the needle and in a helical spiral-like motion, a segmented portion of which travel crosses the path of the needle thread extending between the needle and the work. Moreover, because the movement of the element is positively governed by the slots, the element will move outward and back along identical or superimposed paths. Preferably, the drive member 42 includes means for automatically returning the rod and thread element carried thereby to a predetermined position when the drive member is deenergized.

Figure 3:
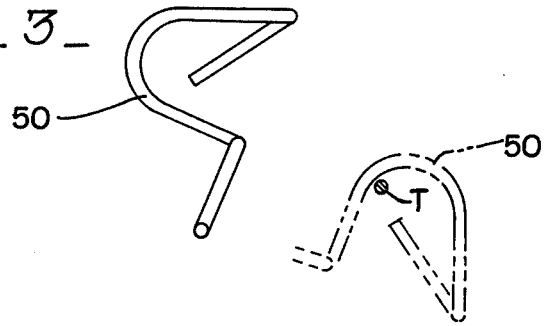
FIG. 3 represents a schematic illustration of the two extreme positions of the thread engaging means.

During the sewing operation, the thread engaging and gripping element is in a retacted position remotely disposed from the needle's path, schematically represented in solid lines in FIG. 3. At the completion of the sewing operation, the needle may be stopped in its fully raised position and the needle thread depending from the needle is severed automatically by the underbed thread trimming mechanism 34. Thereafter, the drive member 42 is energized thereby causing rectilinear displacement of the spindle or rod 48 toward the work support of the machine. During the initial portion of its movement, the thread engaging element is lowered beneath the raised needle along a straight line extending generally parallel to the path of the needle through the cooperation of the spindle roller 56 and the guide element 60. When the spindle roller 56 reaches the helical portion 64 of the guide slot 58, the thread engaging element is at a level between the distal end of the raised needle and the work W. Continued actuation of the drive member causes the spindle roller to traverse the second helical portion of the guide slot whereby causing the element to turn in a helical fashion about the rectilinear axis of the spindle 48. Ultimately, the thread engaging element assumes its second extreme postion shown in dotted lines in FIG. 3. As is appreciated, a segmented portion of the helical movement of the thread engaging element crosses the relatively stationary path of the thread T (FIG. 3) depending from the needle. Because the actuation mechanism is mounted in a self aligning bearing, failure to sever the thread will not result in destructive damage to the mechanism.

On its return to the raised position, the spindle roller 56 and guide 60 cooperate to have the thread engaging element effect a motion opposite to that effected with the downward movement of the element. In its return motion, the thread engaging element is effective to engage the cut thread and move it concurrently upwardly with its own movement to complete the cycle and withdraw and hold the thread end away from the sewing area.

Thus there has been provided a Thread Wiping Mechanism which fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having adequately described the nature of the invention, what we claim is:

1. In a sewing machine having a stitching mechanism including an eye pointed thread carrying needle means operable along a straight line path during the sewing operation, mechanism for securing the loose end of a sewing thread during the initial operation of the stitching mechanism comprising:

spindle means arranged for movement about a fixed axis extending generally parallel to the path of the needle means with an annular bearing projecting transversely therefrom;

thread engaging element means arranged at one end of said spindle means;

a sleeve provided with an anfractuous slot whose side edges tangentially engage and positively guide said bearing to rotate the spindle means and thereby the thread engaging element means outward and back along identical paths; and means for reciprocating the spindle means whereby moving said element through a helical path extending generally parallel to the needle's path with a segmented portion of said helical path crossing the needle thread path below the eye pointed needle.

2. In a sewing machine having a reciprocatory thread carrying needle operative along a generally straight line path during a sewing operation, and a needle thread wiping device comprising:

a thread engaging element; and operating mechanism including a fluidically operated actuator for imparting movement to said thread engaging element such that it travels outward and back along the same path extending generally parallel to the needle's path with a segmented portion of the element's travel crossing the path of the needle thread in a spiral like motion below the needle.

3. In a sewing machine having a stitching mechanism including endwise reciprocable needle bar means having thread carrying eye pointed needle means operable along a generally straight line path, a thread end holder for securing the loose end of a sewing thread during the initial operation of the stitching mechanism comprising:

rod means mounted for rectilinear movement along a path extending generally parallel to the path of the needle means;

a thread gripping element carried by said rod means and movable in a path between two extreme positions, said element moving from its first position remotely disposed from the needle's path along and about a path extending partly parallel to the path of the needle and partly transverse thereto, the combined movement allowing said element to move in a spiral like motion to engage the threads at its second position and subsequently hold and remove the sewing thread away from the eye pointed needle means; and means for imparting movement to said rod means such that the gripping element moves between such extreme positions along the same path of travel.

4. In a sewing machine having a sewing head, work support means arranged beneath said sewing head, eye pointed thread carrying needle means supported within said sewing head for endwise reciprocation along a straight line path during a sewing operation, complimentary stitch forming devices adapted for cooperation with said reciprocatory needle in forming a stitch, thread trimmming mechanism effective to sever the needle thread beneath said work support, and mechanism for drawing the severed needle thread above the work support comprising:

a thread wiping element operative toward and away from said work support along a positively guided path having a spiral-like component and whose major axis extends generally parallel to the needle's path with a segmented portion of said path circularly traversing the path of the needle thread extending between the needle means and the complimentary stitch forming devices; and means for operating said thread wiping element such that its outward and return movements are superimposed and in timed relation to the sewing operation.

5. A needle thread wiping device for use on a machine having a thread carrying needle means supported for reciprocation in an endwise path during a sewing operation, said needle thread wiping device comprising:

a thread engaging element reciprocal along an axis extending generally parallel with said needle path and oscillatable about said axis such that said engaging element rotates about said axis into the path of the reciprocatory needle means; and energizing means for driving and retracting said thread engaging element along the same path of travel and in timed relation to the sewing operation.

6. In a sewing machine having an endwise reciprocatory thread carrying needle operable along a generally straight line path during a sewing operation, a needle thread manipulating mechanism comprising:

thread engaging means shiftably supported for movement intermediate two extreme positions, one position being remotely disposed from the needle's path and the other position being proximate the needle's path; and means for reciprocating said thread engaging element initially along a straight line axis which remains fixed and extends generally parallel relative to the needle's path of travel while subsequently guiding said thread engaging element in a spiral-like motion around the needle's path in a manner capturing the needle thread.

7. A needle thread wiping device for a sewing machine having a thread carrying needle supported for reciprocation along a generally straight line path during a sewing operation, said needle thread wiping device comprising:

thread engaging element means having combined reciprocatory and oscillatory movements along and about a fixed axis extending generally parallel to the needle's path, the combined movement being positively controlled and timed such that the element is first moved linearly downward, subsequently driven in a curvilinear like motion around the needle's path to capture the needle thread, and then retracted along the same path of travel to carry the captured thread to a rest position.

8. A needle thread wiping device for a sewing machine having a frame, a work support, and a thread carrying needle supported in said frame for reciprocation in an endwise path, said needle thread wiping device comprising:

a thread engaging element;

actuating means arranged within the frame for successively lowering said thread engaging element toward said work support along a fixed axis extending in a direction generally parallel with the path of the needle, turning said element about said axis in a curvilinear path around and proximate to the path of the needle in a manner capturing the needle thread, and then retracting and raising said engaging element away from said work support along the identical path traversed by said thread engaging element in its movement toward said work support.

* * * * *